US009520655B2

(12) United States Patent
Cerreno

(10) Patent No.: US 9,520,655 B2
(45) Date of Patent: Dec. 13, 2016

(54) DUAL-POLARIZED RADIATING PATCH ANTENNA

(71) Applicant: University Corporation for Atmospheric Research, Boulder, CO (US)

(72) Inventor: Jorge Luis Salazar Cerreno, Boulder, CO (US)

(73) Assignee: University Corporation for Atmospheric Research, Boulder, CO (US)

( * ) Notice: Subject to any disclaimer, the term of this patent is extended or adjusted under 35 U.S.C. 154(b) by 240 days.

(21) Appl. No.: 14/488,432

(22) Filed: Sep. 17, 2014

(65) Prior Publication Data

US 2016/0079672 A1 Mar. 17, 2016

Related U.S. Application Data

(60) Provisional application No. 62/004,332, filed on May 29, 2014.

(51) Int. Cl.

| | |
|---|---|
| ***H01Q 1/38*** | (2006.01) |
| ***H01Q 21/24*** | (2006.01) |
| ***H01Q 21/06*** | (2006.01) |
| *H01Q 1/42* | (2006.01) |

(52) U.S. Cl.

CPC ..... *H01Q 21/24* (2013.01); *H01Q 21/065* (2013.01); *H01Q 1/42* (2013.01)

(58) Field of Classification Search

CPC ..... H01Q 9/045; H01Q 1/42; H01Q 1/48; H01Q 21/26

USPC ..... 343/700 MS, 848, 846, 797

See application file for complete search history.

(56) References Cited

U.S. PATENT DOCUMENTS

| | | | | |
|---|---|---|---|---|
| 4,903,033 | A * | 2/1990 | Tsao | H01Q 9/0414 343/700 MS |
| 6,054,953 | A * | 4/2000 | Lindmark | H01Q 1/38 343/700 MS |
| 2009/0213013 | A1* | 8/2009 | Lindmark | H01Q 9/0435 343/700 MS |
| 2015/0295309 | A1* | 10/2015 | Manry, Jr. | H01Q 15/0066 342/374 |

* cited by examiner

*Primary Examiner* — Hoanganh Le

(74) *Attorney, Agent, or Firm* — The Ollila Law Group LLC

(57) ABSTRACT

A dual-polarized patch antenna, an dual-polarized patch antenna array, and a method for forming the same are provided. The dual-polarized patch antenna comprises a radome, a horizontal feed and a vertical feed, a first cross-shaped patch, and a ground plane including a cross aperture. The dual-polarized patch antenna may include a cross patch and a cross aperture to increase the isolation in a cross-polarization between a horizontal polarized signal and a vertical polarized signal in a first principle plane and to decrease a mismatch in co-polarizations between the horizontal polarized signal and the vertical polarized signal in a second principle plane.

18 Claims, 8 Drawing Sheets

DUAL-POLARIZED RADIATING PATCH ANTENNA

CROSS-REFERENCE TO RELATED APPLICATION

This application claims priority from U.S. Provisional Patent Application No. 62/004,332, filed May 29, 2014, entitled "Dual-polarized Radiating Patch Antenna," the contents of which are incorporated herein by reference.

GOVERNMENT LICENSE RIGHTS

This invention was made with Government support under the National Science Foundation Directorate for Geosciences Division of Atmospheric and Geospace Sciences with Award Numbers M0904552 and M0856145. The Government has certain rights in this invention.

TECHNICAL FIELD

The present Application relates to antennas, and more particularly, to an improved method and apparatus for a patch antenna.

BACKGROUND OF THE APPLICATION

Patch antennas, or microstrip antennas are widely used in the wireless, radar, automobile, military, and space industries. Patch antenna technology offers low-profile, low-cost features that are fundamental for the wireless and communication industries. Cell phones, GPS, use dual-polarized antenna elements and also antenna elements configured in arrays to increase gain and to focus directivity.

One important application for a patch antenna is in meteorology. Dual polarization diversity is often used in meteorological radar to improve the accuracy of radar measurements, for example to better characterize hydrometeors. In addition to providing improved hydrometeor classification and precipitation estimation, polarimetric radar may also provide multi parameter measurements that reveal the detailed microphysics of storms. Dual-polarized antennas may be integrated into instruments in satellite, airborne synthetic aperture radar (SAR), two-dimensional electronically-scanned radar, and dual-polarized planar phased array radars.

In phased array radars, the accuracy of measurements obtained are particularly vulnerable to the features of the dual-polarization. For example, differential reflectivity (ZDR) is particularly vulnerable to changes in the polarization basis. The range for ZDR values for hydrometeors varies from approximately 0.1 dB for drizzle and dry snow to 4 dB for heavy rain and large drops. In order to obtain accurate results, the measurement error for ZDR must be on the order of 0.1 dB. To obtain such low ZDR error values, an antenna must feature high polarization isolation (optimally >25 dB for alternate transmit) and high match (optimally <7%) between the main beam antenna power patters.

Polarization isolation below −25 dB is difficult to obtain using prior art dual-polarized planar patch array antennas. While some dual-polarized patch antenna designs may provide low cross-polarization (below −30 dB) in the vertical and horizontal planes, previous designs have failed to provide cross-polarization better than 20 dB in the diagonal plane where the coupling between fields in H and V are significantly higher. In order to overcome this limitation, electronically scan phased array radars have been designed to perform in the principal planes only.

What is needed is radiating element that provides greater isolation in the diagonal plane, with a high match between the co-polar beam antenna patterns for both polarizations (H and V), for both in use as a single element or in a finite planar array.

The present Application overcomes these and other problems and an advance in the art is achieved. The dual-polarized patch antenna element proposed overcomes the problems of isolation in the diagonal plane and mismatch between the horizontal and vertical co-polarizations by combining the features of a parasitic crosspatch antenna and a ground plane with a cross-shaped aperture and capacitive and inductive loading corners.

Independent-fed networks are used to excite the horizontal and vertical polarization components. The dual-polarized patch antenna design also results in low costs and simplified manufacturing.

SUMMARY OF THE APPLICATION

A dual-polarized patch antenna is provided, according to an embodiment of the Application. The dual-polarized patch antenna includes a radome, a horizontal feed and a vertical feed, a first cross-shaped patch, and a ground plane including a cross aperture.

A dual-polarized patch antenna array is provided, according to an embodiment of the Application. The dual-polarized patch antenna array includes an array of dual-polarized patch antenna elements. Each respective dual polarized patch antenna includes a radome, a horizontal feed and a vertical feed, a cross-shaped patch, and a ground plane including a cross aperture.

A method of forming a dual-polarized patch antenna array is provided according to an embodiment of the Application. The dual-polarized patch antenna array includes a radome, a horizontal feed, a vertical feed, a cross-shaped patch, and a ground plane including a cross aperture. The method includes the steps of forming the ground plane including a cross aperture, forming the cross-shaped patch, and assembling the radome, the horizontal feed, the vertical feed, the cross-shaped patch, and the ground plane.

DETAILED DESCRIPTION OF THE APPLICATION

FIGS. 1-7*d* and the following description depict specific examples to teach those skilled in the art how to make and use the best mode of the Application. For the purpose of teaching inventive principles, some conventional aspects have been simplified or omitted. Those skilled in the art will appreciate variations from these examples that fall within the scope of the Application. Those skilled in the art will appreciate that the features described below can be combined in various ways to form multiple variations of the Application. As a result, the Application is not limited to the specific examples described below, but only by the claims and their equivalents.

Figure 1:
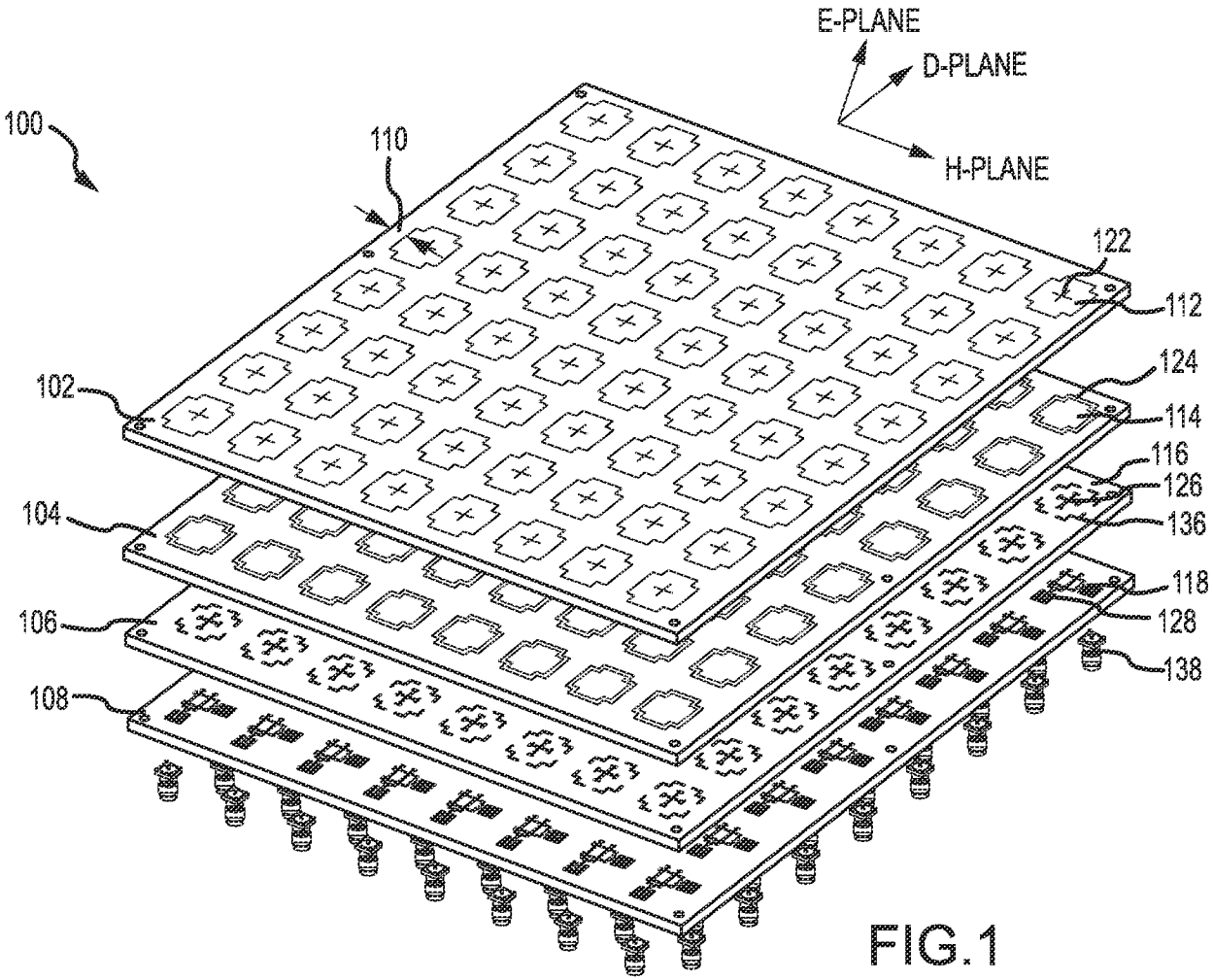
FIG. 1 depicts an exploded view of a dual-polarized patch antenna array, in accordance with an embodiment of the Application.

FIG. 1 depicts an exploded view of a dual-phased patch antenna array 100 in accordance with an embodiment of the Application. In an example embodiment, patch antenna array 100 operates at a frequency of 5.4 GHz. This is not intended to be limiting, however, as the Application contemplates patch antennas that operate at other frequencies.

Figure 2:
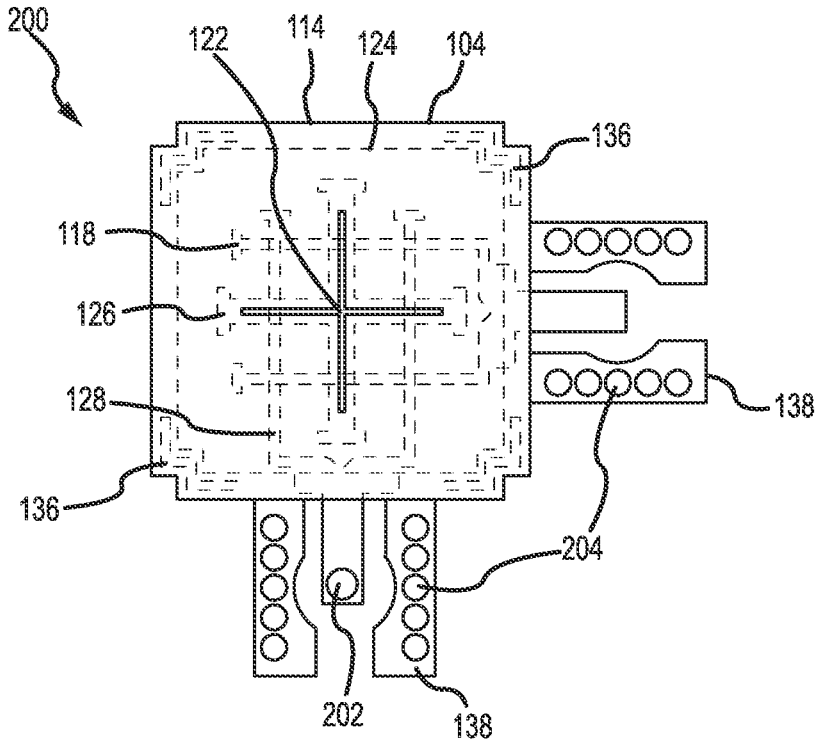
FIG. 2 depicts a top transparent plan view of a dual-polarized patch antenna element, in accordance with an embodiment of the Application
Figure 3:
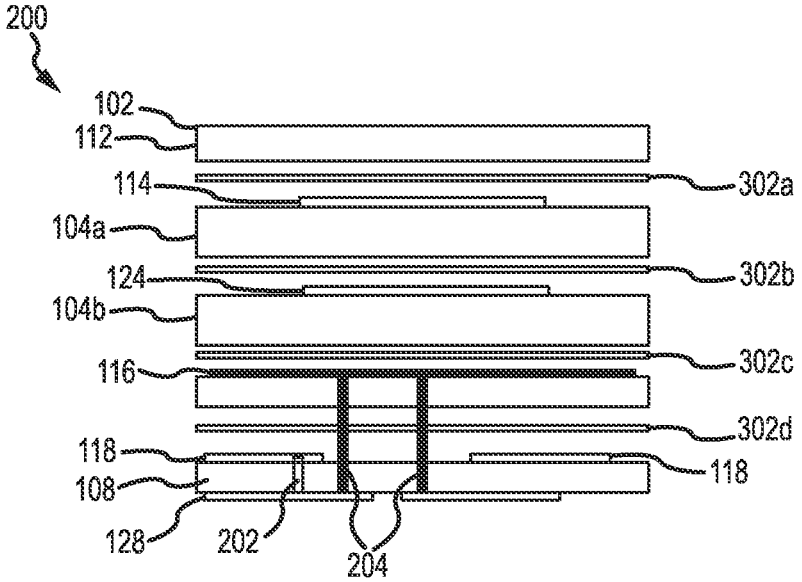
FIG. 3 depicts a side view of a dual-polarized patch antenna element, in accordance with an embodiment of the Application.

FIGS. 2 and 3 depict an individual patch antenna 200. Patch antenna array 100 is an 8×8 array of individual patch antenna 200 elements. FIG. 2 presents a top transparent plan view of an individual patch antenna 200. FIG. 3 presents a side view of patch antenna 200. FIGS. 4*a*-4*f* depict further details of the features found in patch antenna 200.

As may be seen from FIG. 1, Patch antenna array 100 includes a radome layer 102, a patch layer 104, a ground plane layer 106, and a feed layer 108. The radome layer 102 includes multiple individual radome 112 elements. The patch layer 104 includes multiple parasitic cross-patch 114 and cross-patch 124 elements. The ground plane layer 106 includes multiple individual ground plane 116 elements, each ground plane 116 element including a cross aperture 126 and four capacitive and inductive loading corners 136. The feed layer 108 includes horizontal feeds 118, vertical feeds 128 and connectors 138. Patch antenna array 100 further includes a border 110.

Patch antenna array 100 is a dual-polarized antenna that may be used to transmit or receive a signal. In the example of FIG. 1, patch array antenna 100 is an 8×8 array of patch antenna elements. This is not intended to be limiting, however, as the present Application contemplates patch antenna arrays with any number of patch antenna elements in any arrangement, including a single patch antenna element. In embodiments, patch antenna array 100 may be integrated into a phased-array radar application. For example, patch antenna array 100 may be integrated into an electronically scanned phased-array radar. While patch antenna array 100 is depicted in FIG. 1 as being substantially planar in shape, in embodiments patch antenna array 100 may be shaped to match any non-planar or curved surface.

Patch antenna array 100 includes radome layer 102. Radome layer 102 includes individual radome 112 elements. Radome layer 102 provides weather proofing and improves the impedance bandwidth for individual patch antenna elements. The radome layer 102 may be made from dielectric, or any other material commonly known to those of skill in the art. In an example embodiment, radome layer 102 may be formed from a uniform sheet of Rogers 5880LZ laminate having a thickness of 10 mil.

Figure 4A:
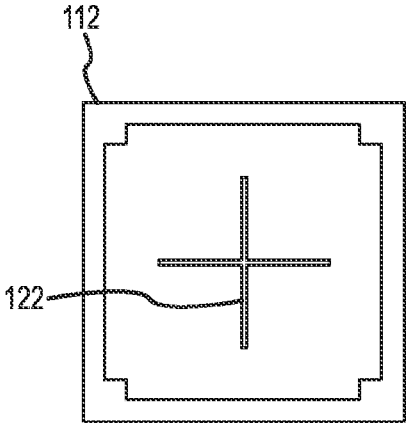
FIG. 4*a* depicts a top view of a radome, in accordance with an embodiment of the Application.

FIG. 4*a* provides a detail of individual radome 112. Radome 112 is a substantially square-shaped cover for a patch antenna element. In embodiments, radome element 112 may be formed into any other shape, however. Radome 112 may be sized to substantially cover individual patch element 200 or any subsection of patch antenna array 100. Radome 112 may further include a cross marking 122 to indicate the location of individual antenna elements in the antenna array, which will be aligned under radome 112.

Returning to FIG. 1, it may be seen that patch antenna array 100 further includes patch layer 104. Patch layer 104 is a dielectric substrate upon which individual conductive metal parasitic cross patches 114 and parasitic cross patches 124 may be located. Parasitic cross patch 114 and cross patch 124 may be formed out of copper or any other conducting metal known to those of skill in the art. Parasitic cross patch 114 elements and cross patch 124 elements may be fabricated individually and coupled to patch layer 104. Parasitic cross patch 114 elements and cross patch 124 elements may also be formed directly upon opposing sides of patch layer 104.

It may be seen from the side view of patch antenna 200 provided in FIG. 3 that patch layer 104 may be further subdivided into a patch layer 104*a* and a patch layer 104*b*.

Patch layers 104*a* and 104*b* may each provide a substrate upon which parasitic cross-patch 114 and cross-patch 124 may be fabricated. For example, parasitic cross-patch 114 and cross-patch 124 may be photo etched onto patch layers 104*a* and 104*b* respectively. The substrate that forms patch layers 104*a* and 104*b* may be any material used in multilayer printed circuit boards (PCB) known to those skilled in the art. In an example implementation, patch layers 104*a* and 104*b* may be formed from Rogers 5880LZ laminate having a height of 50 mil. Patch layers 104*a* and 104*b* may be bonded together with adhesive 302*b* to create single patch layer 104, as may be seen in FIG. 3. Radome layer 102 may be further bonded to patch layer 104*a* with adhesive 302*a*.

Figure 4D:
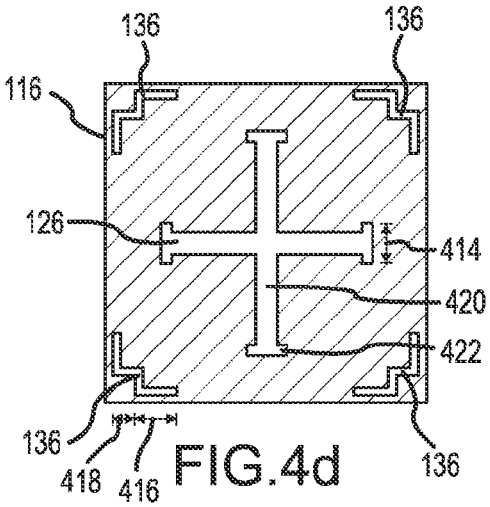
FIG. 4*d* depicts a top view of a ground plane, in accordance with an embodiment of the Application.
Figure 4B:
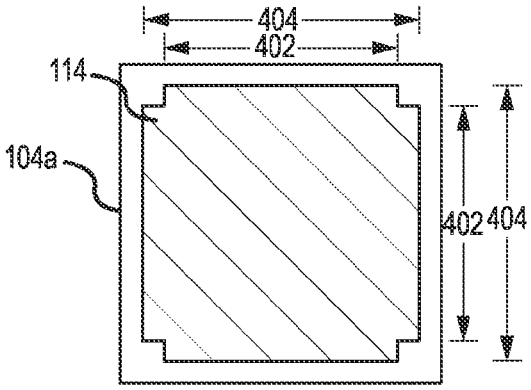
FIG. 4*b* depicts a top view of a parasitic cross patch, in accordance with an embodiment of the Application.

FIG. 4*b* provides a detail of parasitic cross-patch 114. As it may be seen from FIG. 4*b*, parasitic cross-patch 114 is cross-shaped, bearing a form geometrically equivalent to two rectangular segments that bisect one another at a right angle. The two rectangular segments have identical length 404 and width 402 dimensions. In the detail of FIG. 4*b*, parasitic cross-patch element 114 is shaped by rectangular strips with a width 402 that is a large fraction of the length 404 dimension, creating a cross with fat segments. Parasitic cross-patch 114 may be used to improve bandwidth for adequate scanning performance in the array. In the example embodiment, the 402 and 404 dimensions may be 13.2 and 14.8 mm respectively. In other embodiments, the 402 and 404 dimensions may be different, however.

Figure 4E:
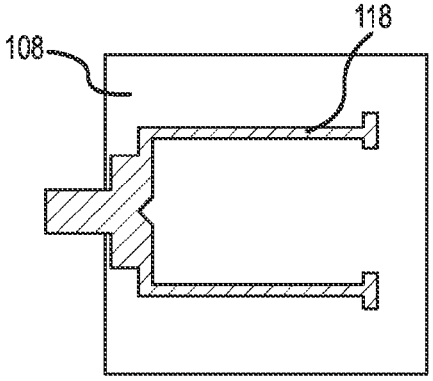
FIG. 4*e* depicts a top view of a horizontal feed, in accordance with an embodiment of the Application.
Figure 4C:
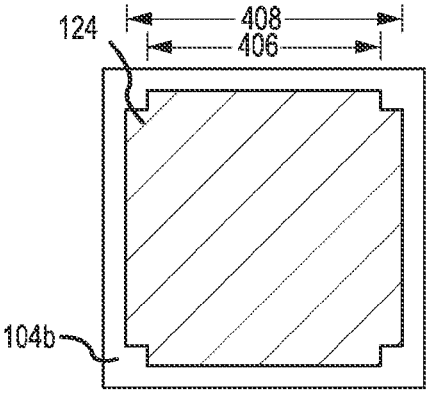
FIG. 4*c* depicts a top view of a cross patch, in accordance with an embodiment of the Application.

FIG. 4*c* provides a detail of cross patch element 124. As it may be seen from FIG. 4*c*, cross patch element 124 is cross-shaped much like parasitic cross patch 114, bearing a form geometrically equivalent to two rectangular segments that bisect one another at a right angle. The two rectangular segments have identical length 408 and width 406 dimensions. It may further be seen from FIG. 2 that in cross-patch 124 is smaller than parasitic cross-patch 114. In an example embodiment, the 406 and 408 dimensions may be 14.3 and 15.9 mm respectively. This is in no way intended to be limiting, however. In further embodiments cross-patch 114 and cross-patch 124 may be the same or different dimensions.

Returning to FIG. 1, it may be seen that patch antenna array 100 further includes the ground plane layer 106. Ground plane layer 106 includes individual ground planes 116, a detail of which is provided in FIG. 4*d*. Ground plane layer 106 may include a substrate upon which ground plane 116 elements may be fabricated from copper or any other conductive material known to those skilled in the art. In embodiments, ground plane layer 106 may incorporate multiple ground planes 116 into a continuous conductive layer. In other embodiments, however, ground planes 116 may be formed individually in a non-continuous manner. Ground plane layer 106 may be bonded to patch layer 104 with adhesive 302*c*, as may be seen from FIG. 3.

FIG. 4*d* provides a detail of ground plane 116. As it may be seen from FIG. 4*d*, ground plane 116 includes a cross aperture 126, which consists of identical bisecting slots 420 cut into a ground plane 116. In the example of FIG. 1, the cross aperture 126 forms a cross with identical widths 410 and lengths 412. Cross aperture 126 further includes four rectangular segments 422 with identical lengths 414 which are superimposed over each end of the bisecting slots 420 that form cross aperture 126. With the addition of the four segments 422, each slot 420 of cross aperture 126 features a dog-bone shape, forming a Jerusalem cross when the slots 420 bisect. In the example embodiment, the width 410 of slot 420 is 1 mm, the length 412 is 10.6 mm. The length 414 of segment 422 is 2 mm. Advantageously, the Jerusalem cross shape may improve the cross-polarization in the E, H, and D planes. The Jerusalem cross shape may also reduce backlobe radiation for the antenna. In an example embodiment, FIG. 4*d* is not intended to be limiting, however. In other embodiments, cross aperture 126 may be formed into any other cross shape, for example cross aperture 126 may be formed as a simple cross with bisecting rectangular segments.

Ground plane 116 further includes four capacitive and inductive loading corners 136. Each capacitive and inductive loading corner 136 forms a "W" shaped aperture consisting of four substantially perpendicularly oriented segments. Capacitive and inductive loading corners 136 are located proximate to the corners of ground plane 116. Each capacitive and inductive loading corner 136 is formed from four connecting segments, two identical longer segments 416 and two identical shorter segments 418. The longer segments 416 are positioned perpendicularly with respect to one another, and are connected at their inner edges via the two shorter segments 418, which are also positioned perpendicularly with respect to one another so that all four segments connect to form the "W" shape of the 136 corner. In the example embodiment of the Application, longer segment 416 is 2.5 mm and shorter segment 418 is 0.76 mm. While the example of patch antenna array 100 and antenna array 200 include a ground plane with capacitive and inductive loading corners, this Application also contemplates dual-polarized patch antennas without capacitive and inductive loading corners.

In embodiments, dimensions 402 and 404 of the parasitic cross patch 114, dimensions 406 and 408 of the cross patch 124, and dimensions 410, 412, and 414 of the cross slot 126 may be tuned to achieve a desired bandwidth (for example, ~6%) and reduce back lobe radiation. For example, back lobe radiation may be reduced below −20 dB alleviating the need for a reflector in the back of patch antenna 200.

In embodiments, the capacitive and inductive corners 136, dimensions 402 and 404 of the parasitic cross patch 114, and dimensions 406 and 408 of the cross patch 124 may be tuned to reduce the cross-polarization isolation in the H, E, and D planes.

Returning to FIG. 3, it may be seen that, ground plane 116 may be larger than parasitic cross-patch 114 and cross-patch 124. From the top, transparent plan view of FIG. 2, it may be further seen that the cross aperture 126 of ground plane 116, the centered cross marking 122 of radome 102, the centers of cross patch 114, and parasitic cross patch 124 may all be centered and aligned. Capacitive or inductive loading corners 136 may furthermore be situated between the perimeter edges of parasitic cross-patch 114 and cross-patch 124.

Advantageously, the combination of cross patch 124 and cross aperture 126 in ground plane 116 may promote the suppression of cross-coupling between the horizontal and vertical polarized electric fields (E-plane, H-plane, and D-plane respectively), enabling high polarization purity to be obtained for a single radiating element or a finite planar array. The combination of cross patch 124 and cross aperture 126 may further promote match between the co-polarizations in the H-plane and E-plane.

Returning to FIG. 1, patch antenna array 100 further includes feed layer 108. Feed layer 108 is a substrate including individual horizontal feeds 118, and individual vertical feeds 128, in addition to SMA connectors 138. Horizontal and vertical feeds 118 and 128 may be may be formed out of copper or any other conducting material commonly known to those skilled in the art. In the example embodiment, feed layer 108 may be fabricated from Rogers 4350 with a thickness of 16.6 mil. Feed layer 108 may be bonded to ground plane layer 106 with adhesive 302*d*.

Figure 4F:
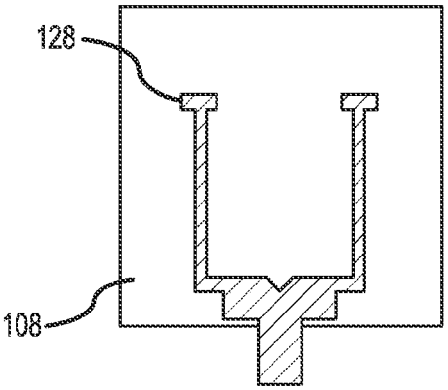
FIG. 4*f* depicts a top view of a vertical feed, in accordance with an embodiment of the Application.

FIG. 4*e* provides a detail of horizontal feed 118, and FIG. 4*f* provides a detail of vertical feed 128. Horizontal and vertical feeds 118 and 128 may be fabricated individually and bonded to opposing sides of a substrate, or fabricated on top of a substrate directly. Advantageously, placing horizontal and vertical feeds 118 and 128 in independent layers may reduce the coupling between feed lines.

In the example embodiment, the horizontal and vertical feeds are power divider feeds. This is not intended to be limiting, however. Any type of feed commonly known to those skilled in the art is contemplated by this Application. Horizontal feed 118 and vertical feed 128 may be fed from independent networks to excite the horizontal and vertical polarization components. Horizontal and vertical feeds 118 and 128 may be used as a two-port antenna element. Horizontal and vertical feeds 118 and 128 may also be used as a four-port antenna element, such as those typically used for series-fed arrays and antennas.

It may be seen from FIG. 2 that horizontal and vertical feeds 118 and 128 are oriented in a substantially perpendicular fashion to provide a dual-polarized signal. A legend on FIG. 1 depicts the polarization of the electric field in the E-plane and H-plane. The legend also indicates the orientation of the D-plane between the E-plane and H-plane. An SMA connector 138 may be coupled to the end of each pair of horizontal and vertical feeds 118 and 128 using any technique commonly known to those of skill in the art. It may be further seen from FIGS. 2 and 3 that signal via 202 may be located at one end of vertical feed 128. A series of ground visas 204 may also be coupled to SMA connectors 138.

In embodiments, horizontal and vertical feed 118 and 128 may be placed to match the diffracted surface waves at the edge of patch antenna array 100. Advantageously, this may help create coherent ripples in the embedded element patterns, ensuring a better mismatch between the main beam antenna patterns for H and V polarizations. In embodiments, dual offset balance and reactive power combiners for each polarization join independent feed likes of 100 ohms, which may significantly improve the cross-polarization isolation in the principle E and H planes.

The substrate used to form the layers 102, 104, 106, and 108 described above may comprise separate PCB layers. In embodiments, layers 102, 104, 106, and 108 may be incorporated into a multi-layer PCB to provide a dual-polarized patch antenna array with a low-profile.

While the embodiment of FIGS. 1-4*f* includes both a cross-patch 114 and a parasitic cross-patch 124, this is in no way intended to be limiting. Those skilled in the art will recognize that it is possible to build patch antenna 200 with a high degree of polarization purity and match in co-polarizations in the H-plane and E-plane with a patch layer 104 without parasitic cross patch 124.

Advantageously, the combination of parasitic cross patch 124, cross aperture 126 in ground plane 116, and independent horizontal and vertical feeds may promote the suppression of cross-coupling between the horizontal and vertical polarized electric fields (H-plane and V-plane, respectively), enabling high polarization purity to be obtained for a single radiating element or a finite planar array. The combination of parasitic cross patch 124, cross aperture 126, and independent horizontal and vertical feeds may also promote match between the co-polarizations in the H-plane and V-plane.

In the example embodiment, patch antenna array 100 includes border 110. Border 110 may extend the perimeter of patch antenna array 100 beyond the border of the outermost patch antenna 200 element. The dimensions of border 110 may be selected to provide phase matching between the source of each patch antenna element and the edges of the array antenna on board. The phase matching between the border and the patch antenna elements allows for coherent ripples in the embedded element patterns, which promotes better matching in co-polarization beam patterns between the H-plane and E-plane.

The above-described embodiment of an 8×8 patch antenna array 100 was prototyped and tested, and results are presented in FIGS. 5*a*-7*d*.

Figure 5A:
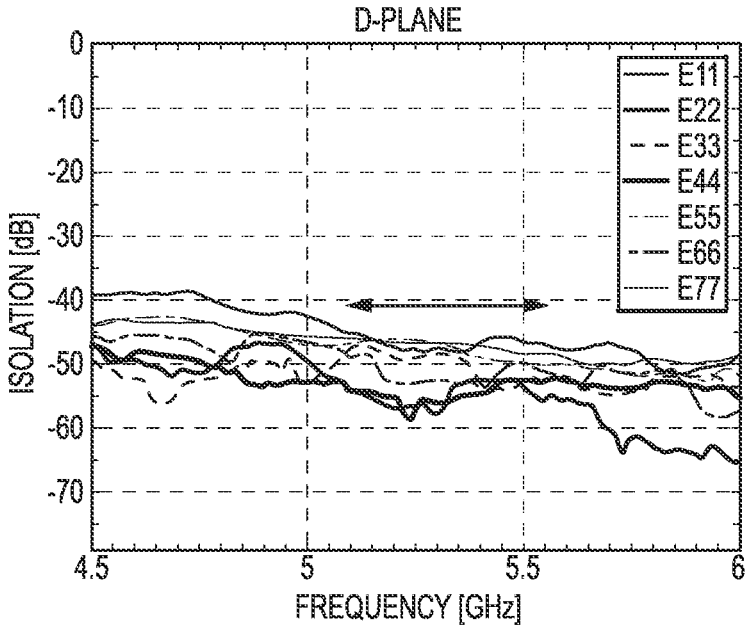
FIG. 5*a* depicts port isolation measurements at an 8×1 linear array of dual-polarized patch antenna elements located in the D-plane of an 8×8 element array antenna, in accordance with an embodiment of the Application.
Figure 5B:
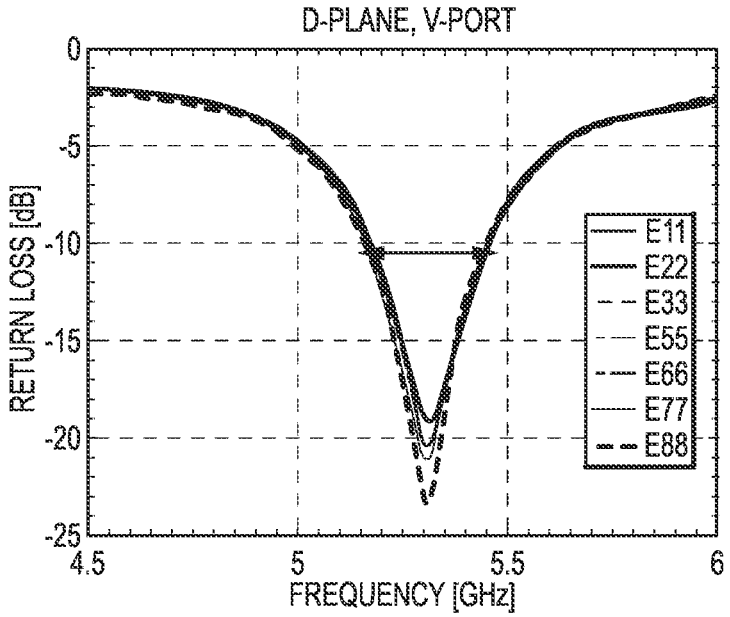
FIG. 5*b* depicts return loss measurements for the V-port at an 8×1 linear array of dual-polarized patch antenna elements located in the D-plane of an 8×8 element array antenna, in accordance with an embodiment of the Application.
Figure 5C:
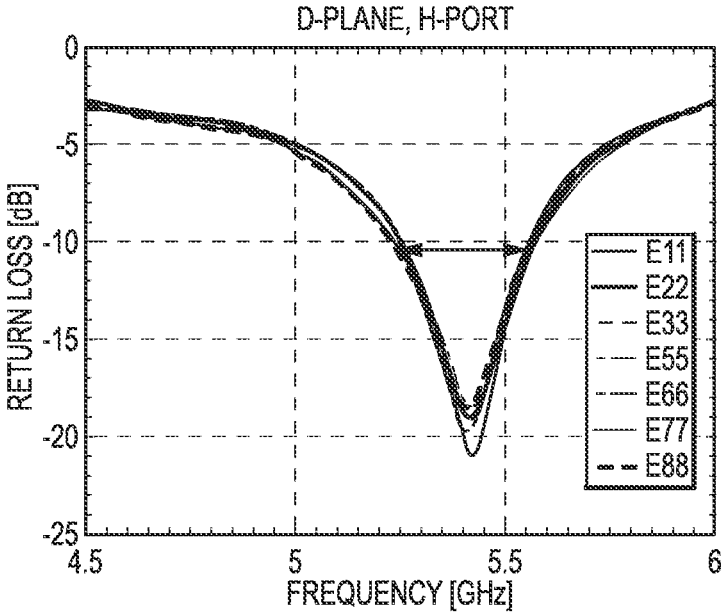
FIG. 5*c* depicts return loss measurements for the H-port at an 8×1 linear array of dual-polarized patch antenna elements located in the D-plane of an 8×8 element array, in accordance with an embodiment of the Application.

The scattering parameters (return loss and isolation) for diagonal elements in the array (E11, E22, E33, E44, E55, E66, E77, and E88) in the E-plane, H-plane, and D-plane were measured using an Agilent Network analyzer, and the results are presented in FIGS. 5*a*-5*c*. The x-axis represents frequency in GHz and the y-axis represents return loss in dB.

FIG. 5*a* depicts port isolation measurements at an 8×1 linear array of dual-polarized patch antenna elements located in the D-plane of an 8×8 element array antenna. As may be seen, the isolation for a bandwidth of 340 MHz is better than −40 dB, as indicated by the double-sided arrow on FIG. 5*a*.

FIGS. 5*b* and 5*c* depict return loss measurements. FIG. 5*b* depicts return loss measurements for the V-port at an 8×1 linear array of dual-polarized patch antenna elements located in the D-plane of an 8×8 element array antenna. FIG. 5*c* depicts return loss measurements for the H-port at an 8×1 linear array of dual-polarized patch antenna elements located in the D-plane of an 8×8 element array. As may be seen, better than −18 dB return loss is measured at 5.4 GHz m. A better than −10 dB return loss is also measured for the required bandwidth of 340 MHz, as indicated by the double-sided arrows in FIGS. 5*b* and 5*c*.

Figure 6A:
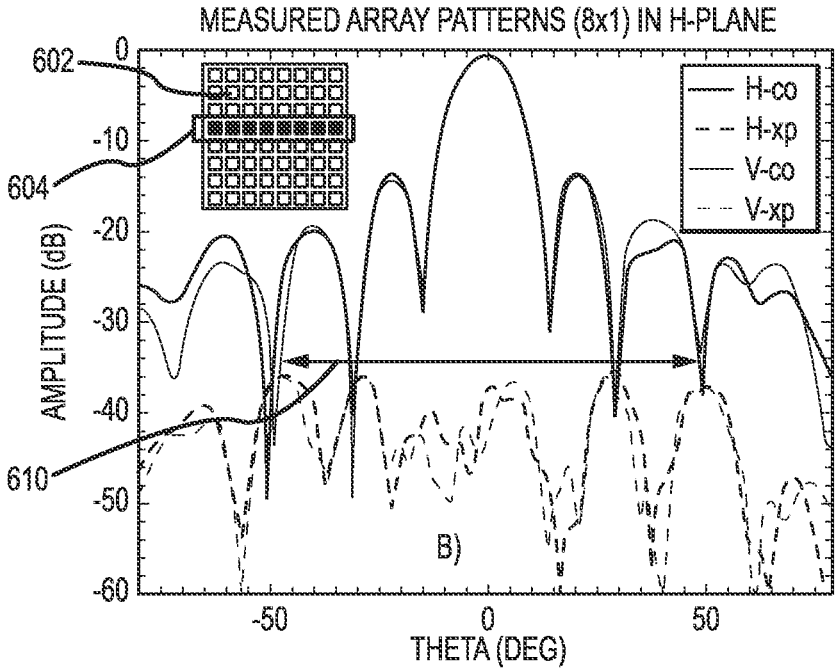
FIG. 6*a* depicts the far-field measured array patterns, including co-polarization and cross-polarization patterns for horizontal and vertical polarizations for an 8×1 linear array of dual-polarized patch antenna elements located in the H-plane of an 8×8 element array, in accordance with an embodiment of the Application.
Figure 6B:
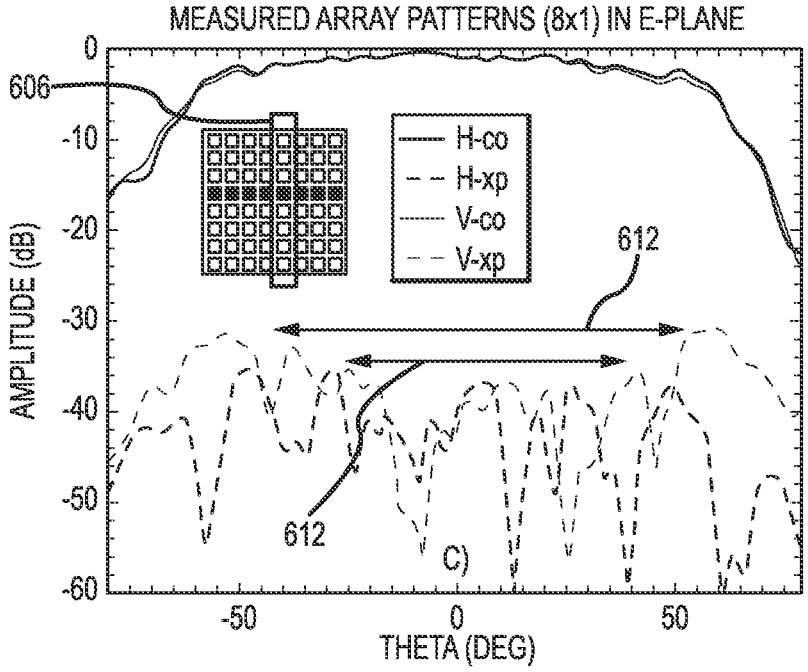
FIG. 6*b* depicts the far-field measured array patterns, including co-polarization and cross-polarization patterns for horizontal and vertical polarizations for an 8×1 linear array of dual-polarized patch antenna elements located in the E-plane of an 8×8 element array, in accordance with an embodiment of the Application.
Figure 6C:
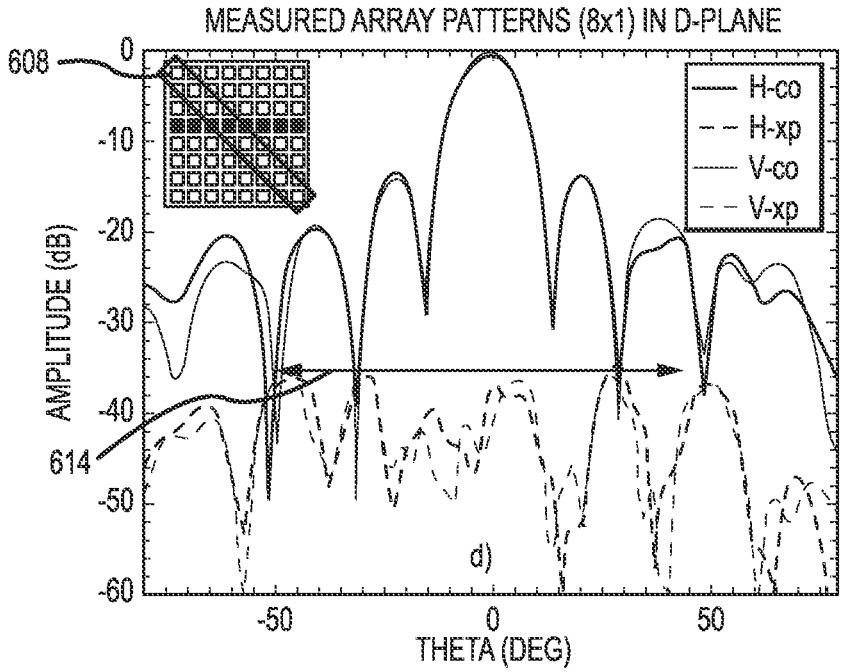
FIG. 6*c* depicts the far-field measured array patterns, including co-polarization and cross-polarization patterns for horizontal and vertical polarizations for an 8×1 linear array of dual-polarized patch antenna elements located in the D-plane of an 8×8 element array, in accordance with an embodiment of the Application.

Antenna patterns for the example embodiment were measured in an anechoic chamber using the first radio frequency (RF) planar Nearfield Systems Inc. (NSI) near-field system. The embedded element patterns in the patch antenna array and also the linear array pattern of 8×1 elements in the H-plane ($\phi$=0°, E-plane ($\phi$=90°), and D-plane ($\phi$=45°) were measured. FIGS. 6*a*-*c* depict the measured patch antenna array beam patterns, including the co-polarizations and cross-polarizations for the H-plane, E-plane, and D-plane at a center frequency of 5.4 GHz. The x-axis represents azimuth $\theta$ and the y-axis represents amplitude in dB. Array 602 in FIGS. 6*a*-6*c* represents the 8×1 elements that were measured.

FIG. 6*a* depicts the far-field measured array patterns, including co-polarization and cross-polarization patterns for horizontal and vertical polarizations for an 8×1 linear array of dual-polarized patch antenna elements located in the H-plane of an 8×8 element array. Measurement dimension 604 indicates that measurements were taken in the H-plane when the 8×1 array was excited in the H-plane. It may be seen from FIG. 6*a* that the main beam demonstrates a good match between H and V patterns, less than a 5% mismatch may be seen. Cross polarization patterns below −35 dB are obtained for both H and V, as indicated by double-sided arrow 610.

FIG. 6*b* depicts the far-field measured array patterns, including co-polarization and cross-polarization patterns for horizontal and vertical polarizations for an 8×1 linear array of dual-polarized patch antenna elements located in the E-plane of an 8×8 element array. Measurement plane 606 indicates that measurements were taken in the E-plane when an 8×1 array was excited in the H-plane. The co-polarization patterns observed correspond to a single element in the E-plane. In FIG. 6*b*, it is possible to observe ripples in the H and V co-polarizations. The ripples observed are below 0.8 dB in amplitude, and well-matched in the H and V co-polarizations. In embodiments, arrays of patch antenna elements including more than 8×8 elements may be used, which may further reduce ripple elements. Cross polarization patterns below −32 dB are obtained for both H and V, as indicated by double-sided arrows 612.

FIG. 6*c* depicts the far-field measured array patterns, including co-polarization and cross-polarization patterns for horizontal and vertical polarizations for an 8×1 linear array of dual-polarized patch antenna elements located in the D-plane of an 8×8 element array. Measurement plane 608 indicates that measurements were taken in the D-plane when an 8×1 array was excited in the H-plane. It may be observed that the H and V co-polarizations are well-matched. Cross-polarization below −35 dB was also obtained, as indicated by double-sided arrow 614.

Figure 7A:
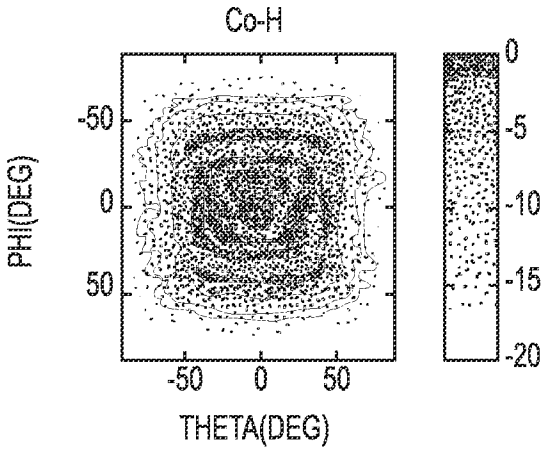
FIG. 7*a* depicts a far-field measured array pattern, including a co-polarization pattern for a horizontal polarization of a center element of an 8×8 element array, in accordance with an embodiment of the Application.
Figure 7B:
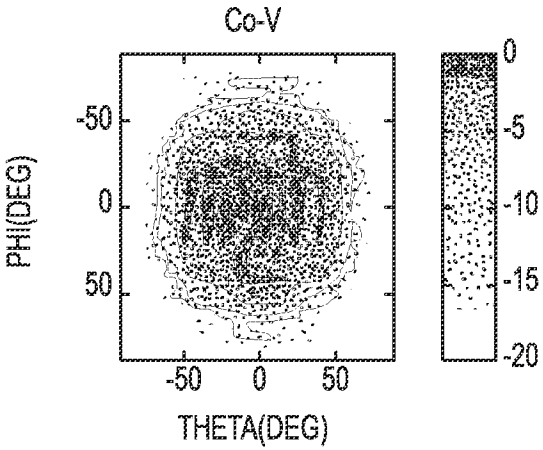
FIG. 7*b* depicts a far-field measured array pattern, including a co-polarization pattern for a vertical polarization of a center element embedded of an 8×8 element array, in accordance with an embodiment of the Application.

FIGS. 7*a*-7*d* depict the far field antenna patterns for a center element for a 8×8 patch array antenna, wherein the other elements in the patch array antenna were terminated with 50Ω loads. FIGS. 7*a* and 7*b* depict co-polarization antenna patterns for the center element for H and V polarizations, respectively. The x-axis represents azimuth Θ and the y-axis represents altitude ϕ. From FIGS. 7*a* and 7*b*, it may be seen that the H and V co-polarizations have less than 5% mismatch.

Figure 7C:
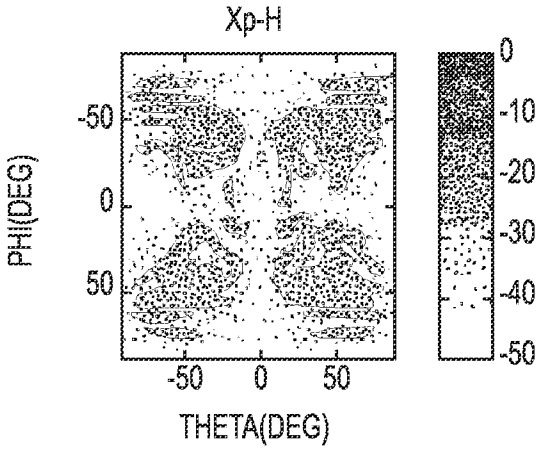
FIG. 7*c* depicts a far-field measured array pattern, including a cross-polarization pattern for a horizontal polarization of a center element of an 8×8 element array, in accordance with an embodiment of the Application.
Figure 7D:
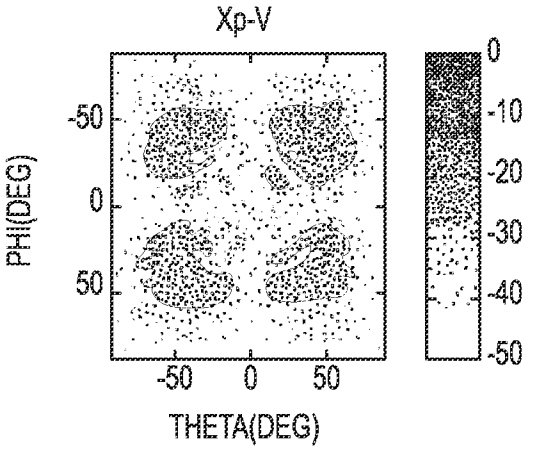
FIG. 7*d* depicts a far-field measured array pattern, including a cross-polarization pattern for a vertical polarization for a center element of an 8×8 element array, in accordance with an embodiment of the Application.

FIGS. 7*c* and 7*d* depict cross-polarization antenna patterns for the center element for H and V polarizations, respectively. From FIGS. 7*c* and 7*d*, it may be seen that a cross-polarization below −25 dB was obtained in the D plane. A cross-polarization below −30 dB was obtained in the E-plane and H-plane.

The present Application describes embodiments that provide a novel apparatus and method for providing a radiating antenna element. The patch antenna element disclosed in the present Application includes new features that permit the suppression of cross-coupling between the H and V polarized electric fields. High polarization purity is obtained for a single radiating element and also for a finite planar array. Beam patterns measured from co-polarizations exhibit a high amount of match as well.

The present Application also describes a antenna radiating element that is comprised in a multilayer PCB and the design will provide a low-profile and low-cost planar phased array antenna.

The detailed descriptions of the above embodiments are not exhaustive descriptions of all embodiments contemplated by the inventors to be within the scope of the Application. Indeed, persons skilled in the art will recognize that certain elements of the above-described embodiments may variously be combined or eliminated to create further embodiments, and such further embodiments fall within the scope and teachings of the Application. It will also be apparent to those of ordinary skill in the art that the above-described embodiments may be combined in whole or in part to create additional embodiments within the scope and teachings of the Application.

Thus, although specific embodiments of, and examples for, the Application are described herein for illustrative purposes, various equivalent modifications are possible within the scope of the Application, as those skilled in the relevant art will recognize. The teachings provided herein can be applied to other precipitation measurement systems, and not just to the embodiments described above and shown in the accompanying figures. Accordingly, the scope of the Application should be determined from the following claims.

I claim:

1. A dual-polarized patch antenna (100), comprising:

a radome;

a horizontal feed and a vertical feed disposed below the radome;

a first cross-shaped patch disposed below the radome and above the horizontal and vertical feeds; and a ground plane including a cross aperture disposed below the first cross-shaped patch and above the horizontal and vertical feeds, wherein the ground plane includes four corners and four capacitive and inductive loading corners, each of the four capacitive and inductive loading corners positioned proximate to a respective corner of the four corners.

2. The dual-polarized patch antenna of claim 1, wherein the cross aperture is formed to increase an isolation between a horizontal polarized signal and a vertical polarized signal in a principle plane below −32 dB, and to provide a match between a co-polar beam pattern of the horizontal polarized signal and a co-polar beam pattern of the horizontal polarized signal below 7%.

3. The dual-polarized patch antenna of claim 1, wherein the first cross-shaped patch is formed to increase an isolation between a horizontal polarized signal and a vertical polarized signal in a principle plane below −32 dB, and to provide a match between a co-polar beam pattern of the horizontal polarized signal and a co-polar beam pattern of the horizontal polarized signal below 7%.

4. The dual-polarized patch antenna of claim 1, wherein the cross aperture is a cross with dog-bone bisecting segments.

5. The dual-polarized patch antenna of claim 1, wherein the horizontal and vertical feeds are power divider feeds.

6. The dual-polarized patch antenna of claim 1, further including a second cross-shaped patch.

7. The dual-polarized patch antenna of claim 1, wherein the second cross-shaped patch is larger than the first cross-shaped patch.

8. The dual-polarized patch antenna of claim 1, wherein the horizontal feed is coupled to a first SMA connector and the vertical feed is coupled to a second SMA connector.

9. The dual-polarized patch antenna of claim 1, wherein the horizontal feed is fed a signal from a first network and the vertical feed is fed a signal from a second network, the first network being independent of the second network.

10. A dual-polarized patch antenna array (100), comprising an array of dual-polarized patch antenna elements, each respective dual polarized patch antenna including:

a radome;

a horizontal feed and a vertical feed disposed below the radome;

a cross-shaped patch disposed below the radome and above the horizontal and vertical feeds; and a ground plane including a cross aperture disposed below the first cross-shaped patch and above the horizontal and vertical feeds, wherein the ground plane includes four corners and four capacitive and inductive loading corners, each of the four capacitive and inductive loading corners positioned proximate to a respective corner of the four corners.

11. The dual-polarized patch antenna array of claim 10, wherein the cross aperture for each respective dual-polarized patch antenna element is formed to increase an isolation between a horizontal polarized signal and a vertical polarized signal in a principle plane below −32 dB, and to provide a match between a co-polar beam pattern of the horizontal polarized signal and a co-polar beam pattern of the horizontal polarized signal below 7%.

12. The dual-polarized patch antenna array of claim 10, wherein the first cross-shaped patch for each respective dual-polarized patch antenna element is formed to increase an isolation between a horizontal polarized signal and a vertical polarized signal in a principle plane below −32 dB, and to provide a match between a co-polar beam pattern of the horizontal polarized signal and a co-polar beam pattern of the horizontal polarized signal below 7%.

13. The dual-polarized patch antenna array of claim 10, wherein the ground plane including a cross aperture for each respective dual-polarized patch antenna element is formed from a single ground plane conductive surface.

14. The dual-polarized patch antenna array of claim 10, further comprising:

a border formed around the dual-polarized patch antenna array, the border having a border width, wherein the border width is formed to match a phase of a dual-polarized patch antenna element to a phase of an outside edge of the border.

15. The dual-polarized patch antenna array of claim 10, wherein the dual-polarized patch antenna array is a square array.

16. A method of forming a dual-polarized patch antenna array including a radome, a horizontal feed, a vertical feed, a cross-shaped patch, and a ground plane including a cross aperture, the method comprising steps of:

forming the ground plane including a cross aperture, wherein the ground plane includes four corners and four capacitive and inductive loading corners, each of the four capacitive and inductive loading corners positioned proximate to a respective corner of the four corners;

forming the cross-shaped patch; and assembling the radome, the horizontal feed below the ground plane, the vertical feed below the ground plane, the cross-shaped patch below the radome and above the ground plane, and the ground plane above the cross-shaped patch and below the radome.

17. The method of claim 16, wherein at least one of the cross aperture and the cross patch is formed to increase an isolation between a horizontal polarized signal and a vertical polarized signal in a principle plane below −32 dB, and to provide a match between a co-polar beam pattern of the horizontal polarized signal and a co-polar beam pattern of the horizontal polarized signal below 7%.

18. The method of claim 16, wherein the horizontal feed is fed a signal from a first network and the vertical feed is fed a signal from a second network, the first network being independent of the second network.

* * * * *